United States Patent [19]

Mettner

[11] Patent Number: 5,076,327

[45] Date of Patent: Dec. 31, 1991

[54] ELECTRO-FLUID CONVERTER FOR CONTROLLING A FLUID-OPERATED ADJUSTING MEMBER

[75] Inventor: Michael Mettner, Ludwigsburg, Fed. Rep. of Germany

[73] Assignee: Robert Bosch GmbH, Stuttgart, Fed. Rep. of Germany

[21] Appl. No.: 712,131

[22] Filed: Jun. 6, 1991

[30] Foreign Application Priority Data

Jul. 6, 1990 [DE] Fed. Rep. of Germany ..... 4021626

[51] Int. Cl.[5] ..... F15C 1/16

[52] U.S. Cl. ..... 137/809; 137/810; 137/813; 91/363 R

[58] Field of Search ..... 91/363 R; 137/810, 813, 137/805, 809, 828

[56] References Cited

U.S. PATENT DOCUMENTS

| | | | |
|---|---|---|---|
| 3,267,946 | 8/1966 | Adams et al. | 137/813 |
| 3,410,291 | 11/1968 | Boothe et al. | 137/810 |
| 3,452,767 | 7/1969 | Pasingies | 137/828 |
| 3,468,326 | 9/1969 | Cohen | 137/810 |
| 3,776,460 | 12/1973 | Fichter | 137/813 |
| 4,091,716 | 5/1978 | Ryan | 137/810 |
| 4,275,691 | 6/1981 | Wolff et al. | 91/363 R |
| 4,867,041 | 9/1989 | Munion | 137/810 |

FOREIGN PATENT DOCUMENTS

| | | |
|---|---|---|
| 1675196 | 7/1971 | Fed. Rep. of Germany . |
| 1675399 | 7/1971 | Fed. Rep. of Germany . |
| 2532668 | 2/1977 | Fed. Rep. of Germany . |

OTHER PUBLICATIONS

"Oil Hydraulic and Pneumatic", vol. 13, No. 10, p. 505, Kopie Aus., 1969.

*Primary Examiner*—A. Michael Chambers
*Attorney, Agent, or Firm*—Michael J. Striker

[57] ABSTRACT

An electro-fluid converter for controlling a fluid actuating an adjusting element, such as a main control slider of a servo valve, comprises at least one displaceable throttle arranged in a fluid-rich circuit. The throttle has at least one throttle element with a central inlet passage and a plurality of flow-mechanical identical base elements arranged around the central inlet passage in a star-like manner. Each of the base elements includes a bipolar wall stream element connected with the inlet passage and a whirling chamber element connected with the wall stream element, each of the wall stream elements being thermoelectrically controllable.

17 Claims, 2 Drawing Sheets

ELECTRO-FLUID CONVERTER FOR CONTROLLING A FLUID-OPERATED ADJUSTING MEMBER

BACKGROUND OF THE INVENTION

The present invention relates to an electro-fluid converter for controlling a fluid-operated adjusting member, in particular the main control slider of a servo valve.

Electro-fluid converters of the above mentioned general type are known in the art. Such converters are used for controlling multi-stage, electro-hydraulic servo valves as disclosed for example in the German document DE-OS 2,532,668. It operates with a relatively high dynamic condition. This converter is made in accordance with a known principle of a double-nozzle with associated baffle plate. The baffle plate is actuated by a torque motor. Both nozzles are arranged in a hydraulic full bridge circuit. This electro-fluid converter is relatively expensive and space consuming. Moreover, the dynamic condition of this first servo valve limits the dynamic condition of the converter.

The German document DE-OS 1,675,196 discloses a construction with bipolar wall stream elements in cooperation with whirling chamber elements or vortex elements. These elements are controlled fluidically. The wall stream elements and the vortex elements are used for forming a counter circuit, and the function of an electro-fluid converter is not performed here.

The technical journal "Oil Hydraulic and Pneumatic" 13, 1969, No. 10, page 505 describes a multi-stage servo valve which is flow mechanically controlled by a fluid input stage. The input stage is however illustrated in a simplified manner. An electro-fluid converter is here not provided.

Furthermore, the German document DE-OS 1,675,399 shows a bipolar wall stream element which is switchable over electrically. For this purpose, electrode plates are arranged in the region of the nozzle of the wall stream element so as to switch over the fluid stream. An electro-fluid converter is also not provided here.

SUMMARY OF THE INVENTION

Accordingly, it is an object of the present invention to provide an electro-fluid converter for controlling a fluid-operated adjusting member, which avoids the disadvantages of the prior art.

In keeping with these objects and with others which will become apparent hereinafter, one feature of the present invention resides, briefly stated, in that throttle means arranged in a fluid bridge circuit includes at least one throttle element provided with an inlet passage and a plurality of identical base elements arranged in a star-like manner around the inlet passage, and each base element includes a bipolar wall stream element connected with the inlet passage and a subsequent whirling chamber element, wherein each wall stream element is thermoelectrically controllable.

When the electro-fluid converter is designed in accordance with the present invention, it eliminates the disadvantages of the prior art. It has the advantage that it can be produced in a relatively cost-favorable manner and in addition provides improved dynamic conditions. Furthermore, the electro-fluid converter can have small size and also is flexible to adapt to different conditions and to be used in these conditions.

The high-dynamic, space consuming and cost-favorable converter can be utilized especially advantageously in hydraulic resistance circuits. The throttle elements can be standardized.

The throttle element has a multi-layer structure, in accordance with another embodiment of the invention which is very favorable for its manufacture.

The multi-layer structure of the throttle element can be produced with the use of micromechanical manufacturing methods, such as for example silicium etching technology or or LIGA process.

Furthermore, the converter is directly digitally controllable. This leads to a relatively low controlling expenses and its flexible use. With controlling of the individual base elements with offset time, a softer transition is possible in the throttle element and no switching jumps occur.

Moreover, the electro-fluid converter can be adapted in a flexible manner to different requirements. For example for increasing the throughflow several throttle elements can be connected in parallel with one another. The parallel connection of the throttle elements provides for a higher resolution. The example an 8-bit, a 16-bit, or a 32-bit operation can be obtained.

Furthermore, such throttle elements can also be arranged in series in order to obtain an increase in the hydraulic resistance.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 1:
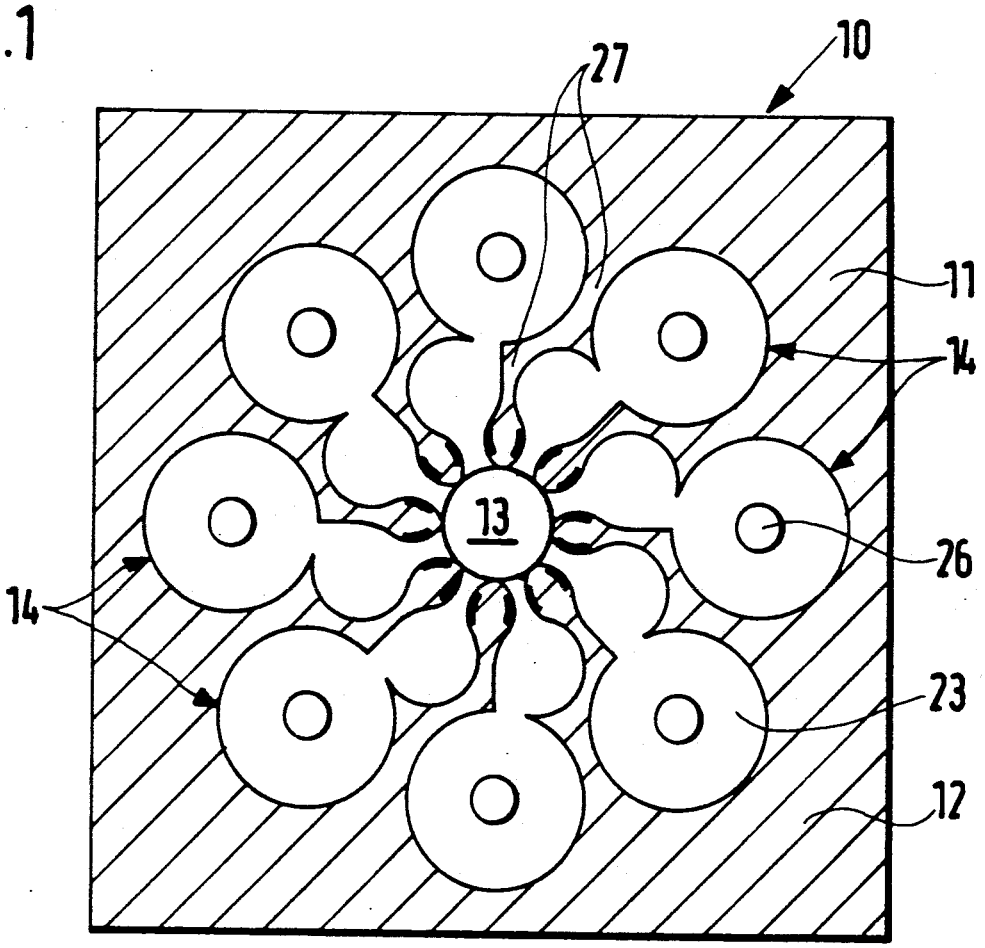
FIG. 1 is a view showing a part of an electro-fluid converter with a throttle element in a simplified manner.
Figure 2:
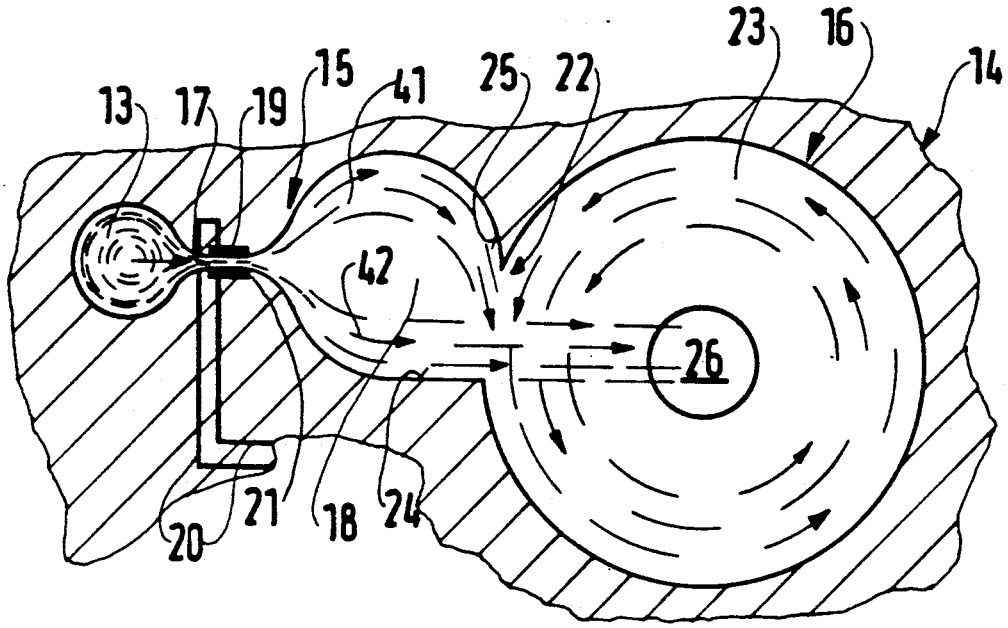
FIG. 2 is a view showing a base element of the throttle element in FIG. 1 of the present invention.

An electro-fluid converter is identified in FIG. 1 as a whole with reference numeral 10. It has a throttle element 11 with eight base elements 14 which are arranged in a star-like fashion in a flat disc 12 around a central inlet passage 13. The base elements 14 are identical. One of the base elements 14 is shown in FIG. 2 on an enlarged scale. It can be seen that the base element 14 has a bipolar wall stream element 15 connected with the inlet passage 14, and a whirling chamber element 16 located after the wall stream element 15. The latter is known under the name of vortex-throttle element. Bipolar wall stream element 15 has a nozzle-shaped passage portion 17 which merges into a substantially circular intermediate chamber 18. Two resistors 19 and 21 are arranged on the opposite walls of the nozzle shaped passage portion 17 and are individually controllable through electrical control connections 20. The intermediate chamber 18 is in communication with a circularly shaped whirling chamber 23 through a window-shaped opening cross-section 22. The opening cross-section 22 in the intermediate chamber 18 is limited by a first wall portion 24 which leads radially to the whirling chamber 23 and also by a second wall portion 25 which extends tangentially to the whirling chamber 23.

Thw whirling chamber 23 has a diameter which is substantially double the diameter of the intermediate chamber 18. The whirling chamber 23 has a centrally extending outlet passage 23. The inlet passage 13 and the outlet passage 26 further extend in a not shown manner in the layers which adjoin the disc 12, as well known in flow-mechanical fluid elements.

As shown in FIG. 1, eight base elements 14 of FIG. 2 are arranged near the throttle element 11 in a star-shaped manner around the inlet passage 13. Therefore, thin-walled material webs 27 remain between the individual base elements 14. The throttle element 11 can be produced in this embodiment relatively simply with micromechanical manufacturing methods, such as for example silica etching technique or LIGA process. The throttle element 11 can be made in a layer structure in which a silicium plate is used as a carrier material and the resistors 19 and 21 as well as the associated control conductors and the associated control electronic elements can be integrated in the individual layers. The throttle element 11 itself is covered by the adjoining layers so that from outside inwardly a single opening is formed for the inlet passage 13 and a single opening is formed for the outlet passage 26. For this purpose the outlet passages 26 of all base elements 14 together extend in a single intermediate plate in a not shown manner.

Figure 3:
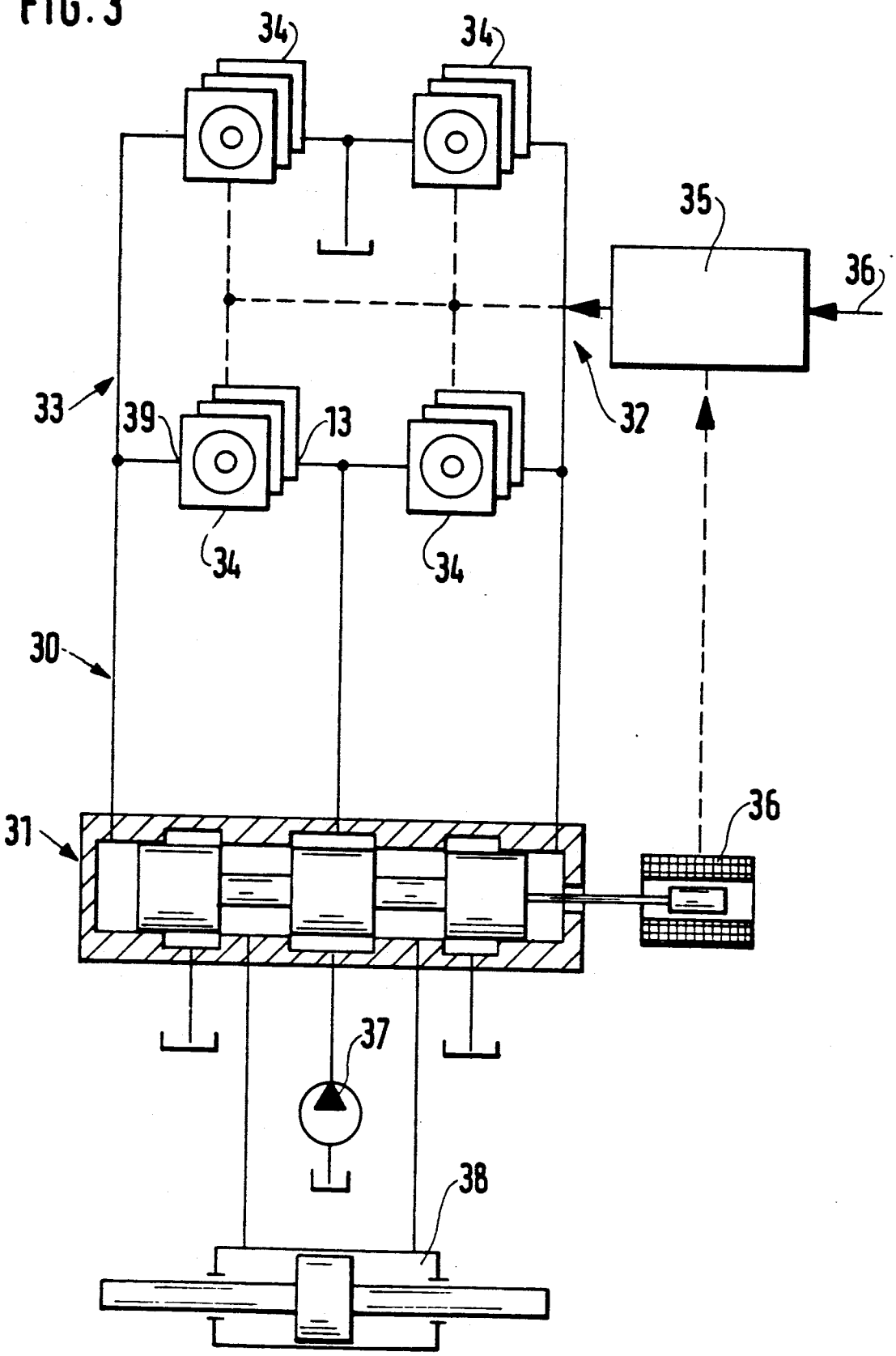
FIG. 3 is a view showing a two-stage electro-dynamic servo valve with the electro-fluid converter of FIG. 1, in accordance with the present invention.

FIG. 3 shows on a simplified view a two-stage servo valve 30. The servo valve has a main stage formed by a conventional 4/3 displacement valve 31 which is electro-hydraulically controlled from a first stage 32. The first stage 32 has a plurality of electro-fluid converters 10 arranged in a hydraulic full bridge circuit 33. Two converters 34 are located upstream of the bridge diagonal and each include several throttle elements 11 connected parallel with one another. A converter 34 is arranged in each of both bridge branches downstream of the bridge diagonal and composed of three throttle elements 11 connected parallel to one another. All bridge branches are formed identically. Four converters 34 located in the bridge circuit 33 are directly controllable by a control electronic unit 35 in a digital manner. The control electronic unit 35 receives the actual value of the position of the control slider in the main stage 31 from an inductive displacement pick-up 36, and is additionally connected with a nominal value input 36.

The 4/3 displacement valve 31 is supplied with a pressure medium from a pump 37 which is also additionally available for the bridge circuit 33. A double acting hydraulic cylinder-piston 38 is connected with the main stage 31.

The operation of the electro-fluid converter 10 is now described in detail with reference to FIGS. 1 and 2.

With the throttle element 11 shown in FIG. 1 the supplied fluid flows in the inlet passage 13 and then flows from the latter through eight base elements 14 arranged in the star-like fashion into their respective outlet passages 26, and then through a not shown collecting passage to the single output opening 39 as can be seen from FIG. 3 for the converter 10. The condition of the fluid in each base element 14 can be clearly seen from FIG. 2. The fluid flows from the inlet passage 13 through the passage portion 17 of the bipolar wall stream element 15 into the intermediate passage 18, so as to flow then through the whirling passage element 16. The volume stream through the nozzle-shaped passage portion 17 adheres, due to the Koanda effect, to one of both side walls of the intermediate passage 18. Under the action of a pressure pulse in the region of the passage portion 17, the stream can be deflected from one wall to the other wall. Depending on this, the volume streams then flow either centrally or tangentially to the whirling chamber 23.

If for example under the action of a current flow from the second resistor 21 the volume stream 41 is deflected to the upper wall in FIG. 2, then it will flow on the second wall portion 25 tangentially to the whirling chamber 23 and forms there a whirl which blocks the discharge of the fluid through the outlet passage 26. If to the contrary, under the action of the current flow in the first resistor 19, the volume stream 42 in FIG. 2 is deflected to the lower wall and flows on the first wall portion 24 centrally and radially to the whirling chamber 23, then no whirl is formed there and the volume stream can discharge with low throttle resistance through the outlet passage 26. During the tangential supply a greater pressure drop occurs between the inlet passage 13 and the outlet passage 26 than in the case of the central or radial supply. In the event of highly viscous fluids the pressure drop can reach substantially the quadrupled value. For switching-over of the volume streams 41 and 42, the effect is used that the resistors 19 and 21 which are heated by the current flow locally evaporate the fluid, and at these locations a pressure pulse is thereby produced to deflect the volume stream.

With this thermo-electric control which is known on the market as ink vapor printer, very high switching frequencies, in particular several kHz are obtained despite the thermal operating principle.

The operation of the individual base element 14 of FIG. 2 is multiplied in the throttle element of FIG. 1, in that eight such base elements can operate. The individual base elements can be controlled by the associated control electronic device 35 individually or in groups and/or also with time offsets, so that in addition to a direct digital control, a soft control without switching jumps is possible.

With the servo valve 30 which is shown in FIG. 3 in a simplified manner, the individual converters 34 are controlled by the control electronic device 35 due to changing throttle resistance, the control pressure in the bridge diagonal correspondingly changes and thereby the control sliders of the main stage are displaced, and their position signal is fed back to the control device 35.

While the converter 10 with individual throttle element 1 operates as digital 8-bit throttle, three throttle elements 11 are connected parallel downstream and upstream of the bridge diagonal in each of four converters 34. Therefore a 32-bit operation is performed.

A high resolution is obtained due to a parallel connection of the throttle elements 11. In addition, with a parallel connection an increase of the through-flow can be achieved.

A pre-control stage can be made with the converters 10 and it has especially good dynamic conditions. The switching times under 200 microseconds are recommended. In addition to the good dynamic conditions of the electro-hydraulic converter, it also insures a space-economical construction, wherein the side length of a throttle element 11 can be under 10 mm.

It is to be understood that some modifications are possible from the shown embodiment, without deviating from the present invention. In particular, the electro-fluid converter can be also used for comparable electro-hydraulic control devices. When needed, the bridge branches can be made with not identical converters.

It will be understood that each of the elements described above, or two or more together, may also find a useful application in other types of constructions differing from the types described above.

While the invention has been illustrated and described as embodied in an electro-fluid converter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. An electro-fluid converter for controlling a fluid actuating an adjusting element, such as a main control slider of a servo valve, comprising at least one displaceable throttle means arranged in a fluid-bridge circuit, said throttle means having at least one throttle element with a central inlet passage and a plurality of flow-mechanical identical base elements arranged around said central inlet passage in a star-like manner, each of the base elements includes a bipolar wall stream element connected with said inlet passage and a whirling chamber element connected with said wall stream element, each of said wall stream elements being thermo-electrically controllable.

2. A converter as defined in claim 1, wherein said bipolar wall stream element in each of said base elements has two outputs formed by a substantially circular intermediate chamber, said whirling chamber elements having a whirling chamber, said intermediate chamber having an opening cross-section which is limited by wall portions extending radially and tangentially to said whirling chamber.

3. A converter as defined in claim 1, wherein said base elements are arranged in a single plane.

4. A converter as defined in claim 1, wherein said throttle elements has a layered micro-mechanically produced multi-layer structure.

5. A converter as defined in claim 4, wherein said throttle element has a carrier material of a semiconductor substance.

6. A converter as defined in claim 5, wherein said carrier material of said throttle element is silicium.

7. A converter as defined in claim 1, wherein each of said base elements of said bipolar wall stream element has a nozzle-shaped passage portion; and further comprising electrical resistors arranged in the region of said nozzle-shaped passage portion for thermo-electrical control.

8. A converter as defined in claim 7, and further comprising means for controlling all resistors of said throttle element.

9. A converter as defined in claim 8, wherein said controlling means is formed to individually control said resistors of said throttle element.

10. A converter as defined in claim 8, wherein said controlling means is arranged to control said resistors of said throttle element in groups.

11. A converter as defined in claim 8, wherein said controlling means is arranged to control said resistors of said throttle element in a predetermined time sequence.

12. A converter as defined in claim 1, further comprising several such throttle elements, said throttle elements being connected parallel to one another.

13. A converter as defined in claim 1, further comprising several such throttle elements, said throttle elements being connected in series to one another.

14. A converter as defined in claim 1, wherein said throttle element has at least eight said base elements arranged in a star-like manner around said inlet passage.

15. A converter as defined in claim 1, wherein said throttle element has at least a multiple of eight of said base elements arranged in a star-like manner around said inlet passage.

16. A converter as defined in claim 1, wherein said converter is arranged in a hydraulic bridge circuit which forms a pre-control stage of an electro-hydraulic servo valve.

17. A converter as defined in claim 1, wherein said throttle element has a side length of at least 10 mm.

* * * * *